United States Patent [19]

Schwelling

[11] Patent Number: 4,773,603

[45] Date of Patent: Sep. 27, 1988

[54] CUTTING MECHANISM FOR DOCUMENT SHREDDER

[76] Inventor: Hermann Schwelling, Bahnhofstrasse 115, D-7777 Salem 3/Neufrach, Fed. Rep. of Germany

[21] Appl. No.: 32,064

[22] Filed: Mar. 27, 1987

[30] Foreign Application Priority Data

Mar. 27, 1986 [DE] Fed. Rep. of Germany ..... 3610537

[51] Int. Cl.[4] ..... B02C 4/08

[52] U.S. Cl. ..... 241/167; 241/236

[58] Field of Search ..... 241/166, 167, 235, 236, 241/242, 243

[56] References Cited

FOREIGN PATENT DOCUMENTS 2749412 1/1986 Fed. Rep. of Germany .

2059804 4/1981 United Kingdom ..... 241/236

*Primary Examiner*—Mark Rosenbaum

*Attorney, Agent, or Firm*—Toren, McGeady & Associates

[57] ABSTRACT

In a cutting mechanism for a document shredder a pair of cutting rollers are disposed in side-by-side relation with disk-shaped circular cutters spaced apart on the rollers. Adjacent circular cutters form annular grooves between them so that the circular cutters on one roller extend into the annular grooves on the other. Wiper plates are located in the annular grooves between the cutters and are arranged in a row extending in the axial direction of the rollers. The wiper plates have tips arranged in a pointed manner with the tips located at the outer circumferential surface of the roller cores. Further, strip-shaped support rods maintain the wiper plates adjacent to the cutting rollers and resting in a positively locked manner on the outer circumferential surfaces of the circular cutters. Each support rod has a pointed tip which engages into an undercut groove in a radially outer surface of each wiper plate.

5 Claims, 1 Drawing Sheet

CUTTING MECHANISM FOR DOCUMENT SHREDDER

The invention is directed to a cutting mechanism for a document shredder according to the preamble of the principal claim, especially herein onto the so-called particle cutters with longitudinal cut and additional transverse severing of the material. A special wiper system for shaft base and cutting roller surface of document shredders of the type discussed here is already indeed known from the DE-PS No. 27 49 482, which consists of side by side wipers completely embracing the roller base and auxiliary wipers resting segment-like upon the roller surface, which are arranged in a row upon common support rods and which are retained in this manner in the housing; this however is precisely a design which affords a multitude of possibilities for the fine and thus unstable cut- up particles to penetrate into the spaces in between the wipers and auxiliary wipers and thus to clog up the entire cutting mechanism after already a very short time.

It is the task of the present invention therefore to modify the basic design of a wiper system known from the state of the art in such a way that an optimum work result is obtained also with particle cutters.

Figure 1:
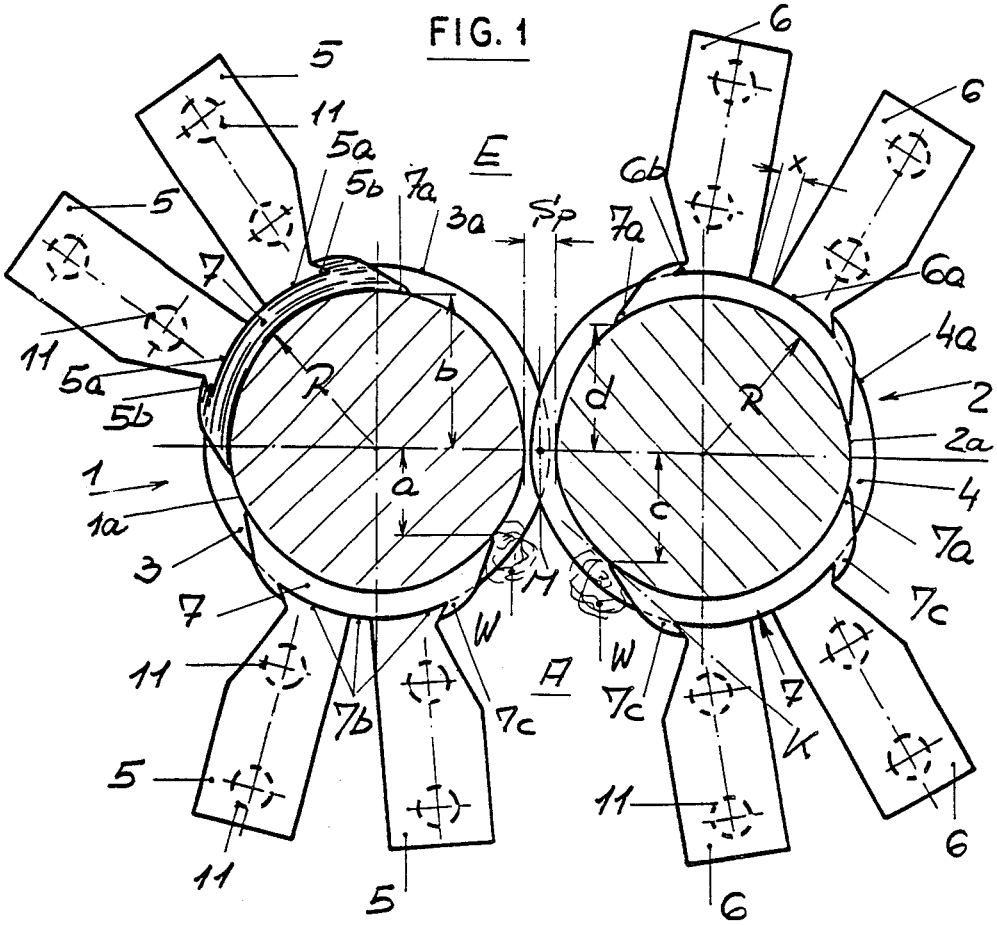

The task defined in the invention is solved by the characteristics stated in the patent claims which are furthermore described in the following in particular with the help of a drawing. The drawing shows herein extensively in schematic presentation in FIG. 1 a cutting mechanism according to the invention and its wiper in cross-section and in FIG. 2 on a smaller scale, a front view upon the cutting mechanism.

Generally the depicted cutting mechanism shows to start off with metal wipers 7 for the cutting rollers 1, 2, in which wipers 7 extend segmentally and with matched radius R up to the roller core 1*a*, 2*a* across the entire roller width B between respectively two disk-like cutter knives 3, 4, said wipers being supported by rods 5 or 6 in the side plates P; it additionally shows wiper elements which rest upon the surface or the outer circumference 3*a*, 4*a* of the cutter disks or circular cutters 3, 4 in the annular grooves between the cutters.

The novelty in the present invention consists now in that the retaining rods 5, 6 for the wipers 7 are designed in strip-shaped manner and the regions 5*a* or 6*a* adjacent to the cutting rollers 1,2 on the one hand rest in a positively locking manner on the external circumference 3*a*, 4*a* of the circular cutters 3,4 and on the other hand comprise a pointed tip 5*b* or 6*b* hook-shaped in cross-section, which engage into an undercut groove 7*b* on the rear of each wiper plate 7, wherein the retaining rods 5 or 6 for the wiper plate 7 are designed as individual strips located in cross-section in mirror image manner and spaced at a distance x from each other extending in divergent fashion outward from the respective footing of the rod 5*a* or 6*a* and wherein the connection between the footing of the rod 5*a* or 6*a* and the groove 7*b* of the wiper plates 7 is designed as a dovetail.

The advantages of this layout are seen on the one hand in that no portions or pocket-like cavities exist any more between the retaining rods, in which the cut-up particles can accumulate; this applies to forward as well as backward rotation of the rollers; any cut-up particles which effectively can still slip past the lugs 7*a* of the wiper plates 7 within the grooves at the disk outer circumference at the latest drop out of the gap between the diverging retaining rods 5 and 6.

A very special advantage of the dovetail design lies however especially therein, that the sensitive tip portions (lugs 7*a*) of the wiper plates 7 are directly held by the dovetail footing 7*b* of the wiper strips according to the broken dotted line K and are thus trengthened as far as their solidity is concerned or are abutted by same. In addition, the smooth external contour of the strips 5 and 6 is important at which thus also no particles can accumulate.

An additional essential characteristic of the invention consists in that the wiper tips 7*a* located at the side of the cutter gap Sp lie at different distances a, b, c, d from the center M of the cover of the cutter disks 3 and 4, wherein in addition the sum of the total distances a+b or c+d from tip 7*a* to tip 7*a* is of different magnitude in each of the two cutter rollers 1 or 2. By this it is above all achieved that the fiber-like cut- up commodity W, which has a woolly consistency and which necessarily clings at the wiper tips 7*a* at the exit side A of the commodity being cut up, does not reach the center M of the cutter disk covering region E at the same time and is there pressed and compacted upon the roller base in addition to the material which in any case is present in the cutting gap. This arrangement guarantees additionally that this material also never appears at the same time on the paper pull-in side E, rather it reaches consecutively the wiper tip 7*a* located there and thus the sum of the wiper resistances to the drive is quasi cut in half and the shock loading is greatly diminished.

Finally, it is also important for the invention that the shoulders 7*c* of the wiper plates 7 lie outside the circumference of the circular cutters 3,4 and that the inner extent of the dovetail groove 7*b* registers with that of the circular cutter external contour 3*a*,4*a*.

Figure 2:
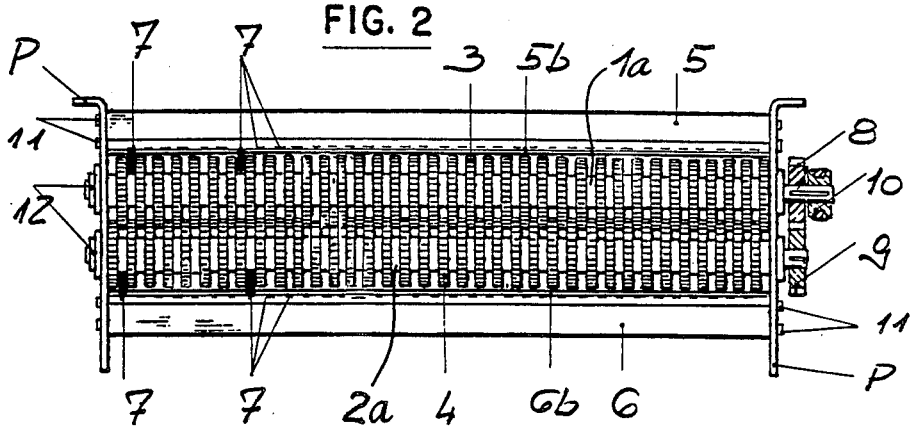

As FIG. 2 shows additionally for the rest of it the cutter rollers 1,2 are coupled through gear wheels 8,9 with the driving wheel 10 thus constituting the drive.

The wiper strips are clamped by screws 11 in the support-housing side plates P, in which are also located the roller supports 12.

I claim:

1. Cutting mechanism for document shredders comprising a pair of axially elongated cutting rollers (1,2) disposed in laterally spaced relation and having ends spaced apart in the axial direction and guided in side support plates (P) extending transversely of the axial direction, each said roller having a roller core (1*a*,2*a*) with an outer circumferential surface, disk-shaped circular cutters (3,4) each with an outer circumferential surface are mounted on each of said rollers in spaced relation in the axial direction and forming an annular groove between adjacent said cutters on the same said roller and said cutters on said rollers partially overlapping in the region of the annular grooves in a cutting gap (Sp) located between said roller cores, and wiper plates (7) projecting inwardly into the annular grooves between said cutters to the roller cores (1*a*,2*a*), said wiper plates (7) arranged in a row extending in the axial direction upon rods (5,6) lying parallel to the cutter rollers (1,2) with tips (7*a*) extending in pointed fashion on the outer circumferential surfaces of the roller cores (1*a*,2*a*), wherein the improvement comprises that the support rods (5, 6) for the wiper plates (7) are designed in strip-shaped manner and having regions (5*a*,6*a*) of the support rods (5,6) adjacent to the cutting rollers (1,2) resting in a positively locking manner upon outer circumferential surfaces (*3a,4a*) of the circular cutters 3,4 and each comprises a pointed tip (*5b,6b*) hook-shaped in cross-section transverse to the axial direction, which engages into an undercut groove (*7b*) at a radially outer surface of each wiper plate (7).

2. Cutting mechanism according to claim 1, wherein the rods (5,6) for the wiper plates (7) are designed as individual strips extending in a divergent fashion from the regions (*5a* or *6a*) adjacent to the cutter rollers (1,2) outwards and which lie spaced from each other by a distance (x) constituting a mirror image in cross-section transverse to the axial direction and that the connection between the regions (*5a,6a*) and the groove (*7b*) of the wiper plates (7) is dovetailed.

3. Cutting mechanism according to claim 1 or 2, wherein the wiper tips (*7a*) located closer to the cutting gap (Sp) lie at different distances (a, b, c, d) from the middle (M) of the cutting gap between the roller cores.

4. Cutting mechanism according to claim 3, characterized in that sum of the total distances (a+b and c+d) from tip (*7a*) to tip (*7a*) is of a different magnitude in each of the two cutting rollers (1,2).

5. Cutting mechanism according to claim 3, characterized in that shoulders (*7c*) of the wiper plates (7) spaced circumferentially from the wiper tips (*7a*) lie outside of the outer circumferential surfaces of the circular cutters (3,4) and that the dovetail groove (*7b*) has an inner extent in register with the outer circumferential surface of the circular cutters (*3a,4a*).

* * * * *